US005967067A

United States Patent [19]

Guenther

[11] Patent Number: 5,967,067

[45] Date of Patent: Oct. 19, 1999

[54] APPARATUS AND METHOD FOR SECURING EMBROIDERY HOOPS

[75] Inventor: Ruth P. Guenther, Racine, Wis.

[73] Assignee: Letter Perfect, Inc., Racine, Wis.

[21] Appl. No.: 09/127,161

[22] Filed: Jul. 31, 1998

[51] Int. Cl.[6] ..... D05C 9/04

[52] U.S. Cl. ..... 112/103

[58] Field of Search ..... 112/103, 470.06, 112/470.14, 470.18, 475.18; 38/102, 102.2; 106/380; 403/360, 375, 376

[56] References Cited

U.S. PATENT DOCUMENTS

| | | | |
|---|---|---|---|
| 4,763,586 | 8/1988 | Takenoya et al. | 112/103 X |
| 5,291,843 | 3/1994 | Hori | 38/102.2 X |
| 5,353,725 | 10/1994 | Sakakibara | 112/103 |
| 5,555,828 | 9/1996 | Rowley | 112/103 |
| 5,630,370 | 5/1997 | Herbach | 112/103 |

*Primary Examiner*—Ismael Izaguirre
*Attorney, Agent, or Firm*—Michael Best & Friedrich LLP

[57] ABSTRACT

An apparatus and method for securing embroidery hoops to a hooping work surface without requiring substantial movement of the hoops with respect to the work surface during attachment and detachment operations. The apparatus preferably includes a body having a ledge defined by a recessed lower surface beneath the ledge, a lip running along the upper edge of the ledge, and a groove running alongside the lip on the upper edge of the ledge. Preferably, the recessed lower surface has an abutment surface which is in the form of a step. The ledge preferably fits in a conventional hoop attachment device between a wedge and a flat lower surface (facing the wedge) of the hoop attachment device. The wedge of the conventional hoop attachment device preferably fits within the groove of the body, while the flat lower surface of the conventional hoop attachment device preferably fits within and abuts against the abutment surface of the body. Positioned in this manner within the conventional hoop attachment device, the hoop is secured against movement during hooping operations. To attach and detach the hoop within the conventional hoop attachment device with minimal movement of the hoop relative to the work surface, the hoop is swung down or up, respectively, through a small angle with respect to the body, thereby placing or removing, respectively, the flat lower surface of the conventional hoop attachment device into abutting relationship with the abutment surface of the body.

20 Claims, 4 Drawing Sheets

APPARATUS AND METHOD FOR SECURING EMBROIDERY HOOPS

FIELD OF THE INVENTION

The present invention relates to the field of embroidery equipment and methods, and more particularly, to the field of equipment and methods for releasably securing embroidery hoops to a work surface.

BACKGROUND OF THE INVENTION

The field of embroidery has experienced a number of developments in recent years as a result of more efficient embroidery operations, systems, and devices. With an eye toward speeding the embroidery process on objects of all types, including shirts, sweatshirts, sweaters, pant legs, shirt sleeves, bags, towels, sheets, etc., many devices and methods have appeared in the marketplace to make the embroidery process more efficient and accurate. One area in which such developments have occurred is the process (and related devices) by which objects to be embroidered are framed or "hooped".

In the hooping process, an object which is to be embroidered is typically draped over or placed upon a work surface. A pair of mating hoops is then secured around the area of the object to be embroidered. Specifically, one of the pair of hoops is placed on one side of the object and another is placed on the opposite side of the object, and then the two hoops are pressed together (one inside the other) with the area of the object to be embroidered being caught therebetween and within the hoops. This hooping process is necessary to keep the material which is to be embroidered flat, taut, and secured while it is being embroidered. This hooping process is also necessary to properly orient the area of the object to be embroidered with respect to the hoops. In particular, after the object to be embroidered is hooped, it is typically placed within an embroidery machine and secured therein by one or more fasteners. The fasteners mate or secure the hoops and object to the machine while the object is being embroidered.

Many devices have been developed for properly orienting and hooping objects to be embroidered. Examples of such devices and methods are disclosed in U.S. Pat. No. 4,767,111 issued to Guenther and co-pending U.S. patent application Ser. No. 09/127,272, the teachings of which are incorporated herein by reference insofar as they relate to the process and devices for hooping objects. Orienting and hooping devices and methods such as these normally require that at least one of the hoops used to hoop an object be secured to a work surface during at least part of the hooping operation. To secure the hoop, one or more brackets are typically used. The bracket(s) is usually secured to the hoop and to the work surface via one or more releasable fasteners as described below.

In the normal operation of the orienting and hooping devices just mentioned, one or more brackets are first positioned upon a work surface and fastened thereto via fasteners. For example, the fasteners can be screws which are passed through holes within the bracket(s) and then through precisely spaced and positioned holes in the work surface. Next, one hoop is attached at one or more attachment positions (usually integral with the hoop) to the bracket(s). Then, the object to be embroidered is placed or draped over the secured hoop, and the second hoop is pressed on top of the object and into or around the first hoop. Finally, the hooped object is removed from the work surface by releasing the first hoop from the bracket(s).

It should be noted that the manners by which hoops are attached and/or released from an embroidery machine on one hand and a bracket attached to a hooping device work surface on the other hand often differ significantly. This difference has created a problem in the art to which the present invention is addressed. Specifically, one common type of conventional attachment device used for hoops is illustrated in FIG. 1. To attach the hoop 1 to an embroidery machine (not shown), the attachment device 2 is slid in the direction indicated by arrow A on FIG. 1. By sliding the hoop 1 and the attachment device 2 in this direction, a mating part of the embroidery machine is caught between the wedge 3 and the flat surface 4 of the attachment device 2, thereby securing the hoop 1 to the embroidery machine. To release the hoop 1 from the embroidery machine, the user slides the hoop 1 and the attachment device 2 in an opposite direction indicated by arrow B on FIG. 1. Other attachment devices similar to those shown in FIG. 1 are well known to those skilled in the art, and operate in much the same manner. For example, the V-shaped wedge 3 shown by way of example in FIG. 1 is only one type of wedge commonly used in such attachment devices 2. Other wedge shapes (such as rounded, rectangular, square, etc.) are possible and exist in the art. Unfortunately, the sliding motion required by the conventional attachment device 2 is often not preferred to attach and detach the hoop 1 from a bracket (not shown) attached to a hooping device work surface. In particular, certain objects positioned or draped over a hooping device cannot easily be moved with the attached hoops in the directions indicated by arrows A and B on FIG. 1. For example, the object being hooped can bind upon the hooping device if shifted in the directions indicated by arrows A and B, or the object can be too tight upon the hooping device to easily shift in such directions. Forcing such an object to shift in such directions can pull the object out of the hoops or disorient the object within its place between the hoops. Therefore, although the attachment device 2 may attach in a manner well suited to embroidery machines, the attachment device 2 may not attach or detach in a manner well suited for operations upon a hooping device work surface.

Therefore, there exists a need for an apparatus and method for securing a hoop (and attached object to be embroidered) to a hooping device work surface which permits easy installation and removal of the hoop without the need for shifting the hoop and object and without pulling the object out of its hoops or distorting the object within the hoops. Such an apparatus and method would ensure that the hoops and object are adequately secured to the hooping device work surface throughout normal hooping operations, yet would be engageable to and releasable from the work surface with minimal movement and effort. The present invention provides such an apparatus and method.

SUMMARY OF THE INVENTION

In a preferred embodiment, the apparatus of the present invention comprises an elongated body having a top surface, a bottom surface, a ledge defined by a recessed portion on the underside of the body and by a groove across the top surface of the elongated body, a lip running along the outermost edge of the ledge, and a raised abutment surface located within the recessed portion of the body. The ledge is sized and shaped to fit within a standard hoop attachment device between a wedge and a facing lower plate on the hoop attachment device. Specifically, the groove on the top surface of the elongated body is sized and shaped to receive the wedge of the standard hoop attachment device, while the facing lower plate of the hoop attachment device fits within the recessed portion on the underside of the body. The wedge is kept in place within the groove by the lip, while the facing lower plate of the hoop attachment device abuts the raised abutment surface in the recessed portion of the body. Preferably, the raised abutment surface is a step which is raised above the surface of the recessed body portion. The step preferably matches the shape of the facing lower plate which is seated and abuts against the step.

The apparatus preferably also includes a notch through the ledge (fully through the top and bottom surfaces of the body) which receives an end wall of the standard hoop attachment device for proper seating of the body within the hoop attachment device. Also, the apparatus preferably includes one or more fastener holes through the body for attachment of the apparatus to a work surface via conventional fasteners (such as threaded screws, pins, etc.). Also preferably, the apparatus has a front surface which faces and abuts a hoop to which the body is attached. The front surface is shaped to match the shape of the hoop, thereby providing for additional contact point(s) and additional stability of the hoop in the apparatus of the present invention.

To connect a hoop to the apparatus of the present invention via the hoop's standard hoop attachment device, a user preferably places the wedge of the hoop attachment device into the groove in the body of the apparatus while the hoop is preferably at an angle (preferably a slight angle) with respect to the body. Preferably at this point, the body has already been attached via fasteners to a hooping work surface. Next, the user swings the hoop to a position in which the hoop is positioned alongside (preferably co-planar to) the body, thereby swinging the facing lower plate of the standard hoop attachment device into the recessed portion of the body abutting the raised abutment surface therein. In this position, the hoop is secured in place on the body, which is trapped between the wedge and the facing lower plate of the standard hoop attachment device. To release the hoop, the user lifts the hoop in an opposite motion through an angle (preferably a slight angle) to pivot the facing lower plate out of the recessed portion of the body. The user then lifts the hoop away from the body.

Because the hoop can be easily installed and released from the apparatus of the present invention as just described (with only a preferably slight lowering or lifting movement of the hoop rather than an undesirable sliding or shifting motion as discussed above), the hoop can be securely installed or removed upon a hooping work surface without disturbing hooping operations or the portion of an object which has been hooped.

More information and a better understanding of the present invention can be achieved by reference to the following drawings and detailed description.

BRIEF DESCRIPTION OF THE DRAWINGS

The present invention is further described with reference to the accompanying drawings, which show preferred embodiments of the present invention. However, it should be noted that the invention as disclosed in the accompanying drawings is illustrated by way of example only. The various elements and combinations of elements described below and illustrated in the drawings can be arranged and organized differently to result in embodiments which are still within the spirit and scope of the present invention.

In the drawings, wherein like reference numerals indicate like parts.

DETAILED DESCRIPTION OF PREFERRED EMBODIMENTS

Figure 1:
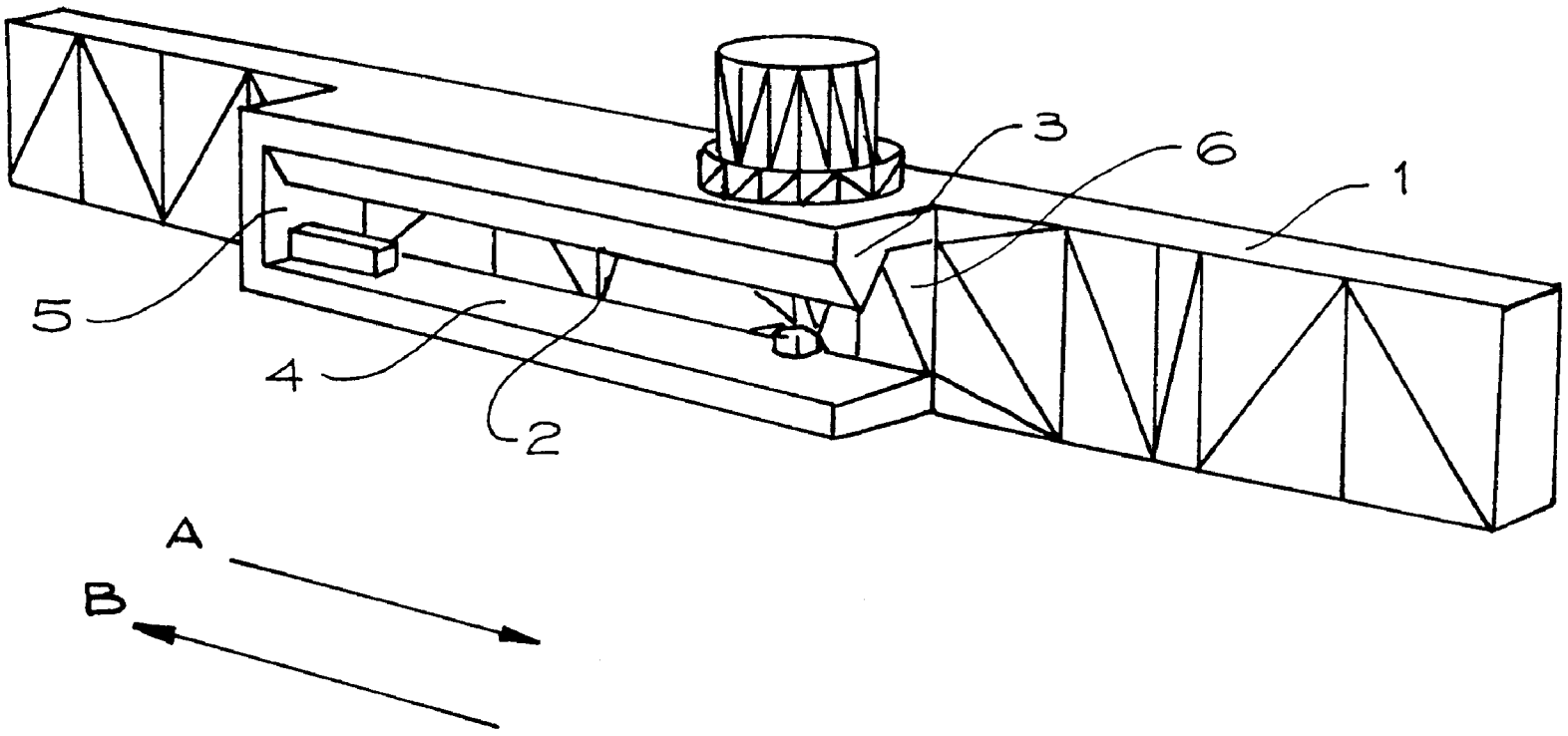
FIG. 1 is a perspective view of a part of a conventional hoop attachment device.
Figure 2:
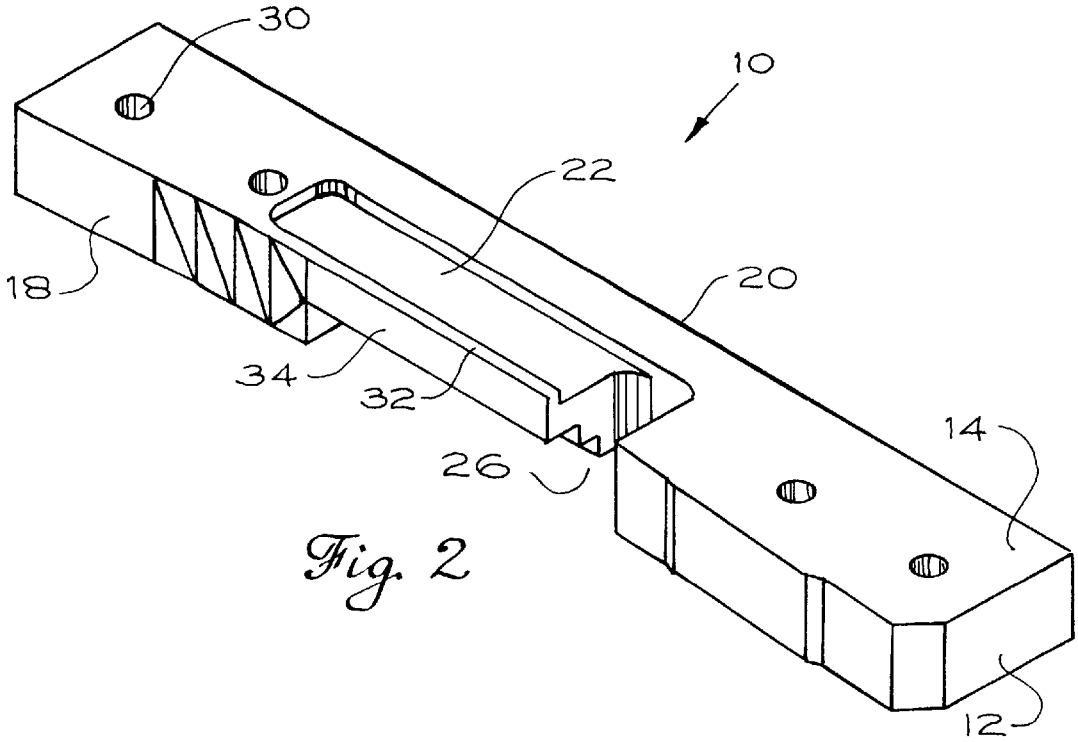
FIG. 2 is a top perspective view of a first embodiment of the hoop bracket according to the present invention.
Figure 3:
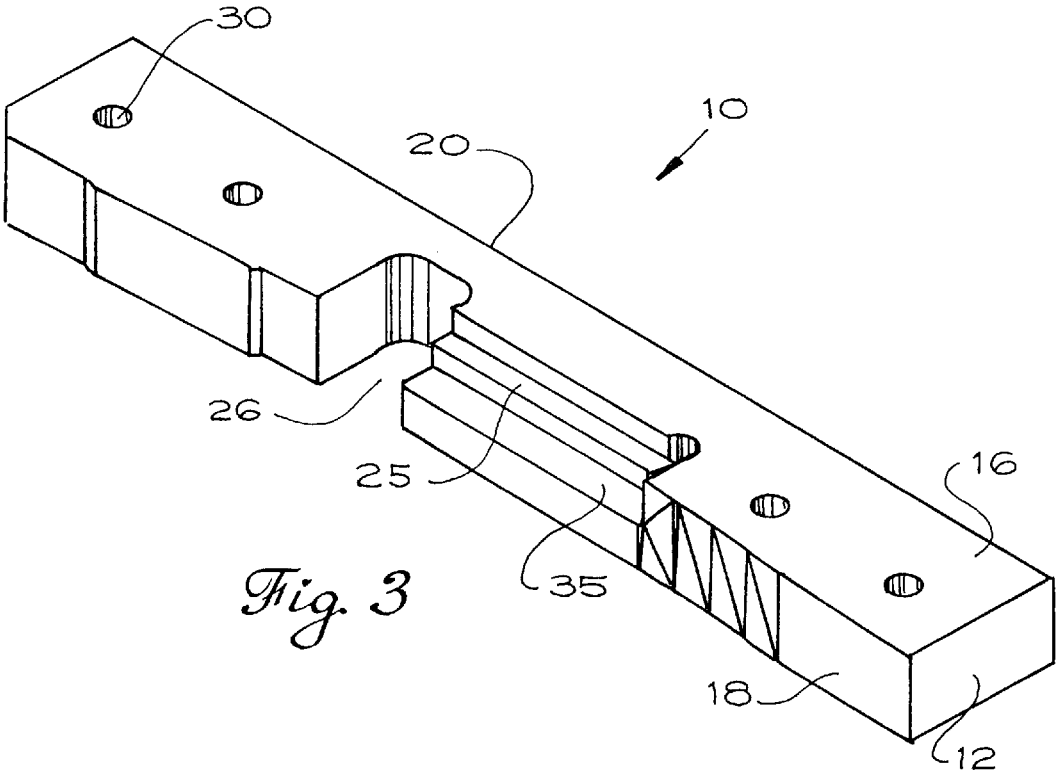
FIG. 3 is a bottom perspective view of the first embodiment of the hoop bracket according to the present invention.

A first preferred embodiment of the present invention is illustrated in FIGS. 2–8. As best shown in FIGS. 2–6, the apparatus of the present invention (designated generally at 10) preferably comprises an essentially elongated body 12 having an upper surface 14, a lower surface 16, a front surface 18 and a rear surface 20, an upper groove 22 located on the upper surface 14, a lower recess 24 on the lower surface 16 and the front surface 18, a notch 26, and one or more fastener holes 30.

The upper groove 22 and lower recess 24 preferably form a ledge on the body which is shaped to be received between the wedge 3 and the flat surface 4, respectively, of a conventional hoop attachment device 2 (see FIG. 1). In particular, both the upper groove 22 and the lower recess 24 are preferably elongated along the length of the elongated body 12. The upper groove 22 preferably defines a lip 32 along one edge 34 of the upper surface 14 of the elongated body 12. When a hoop 1 is installed on the elongated body 12, the wedge 3 of the hoop attachment device 2 preferably fits over the lip 32 of the elongated body 12 as described below. The lower recess 24 of the elongated body 12 preferably has a raised and elongated abutment surface 36 therein. The abutment surface 36 is preferably raised from a base surface 35 of the lower recess 24. When a hoop 1 is installed on the elongated body 12, the flat surface 4 of the hoop attachment device 2 preferably rests against the abutment surface 36 as described below.

The notch 26 is preferably shaped and sized to receive the end wall 5 and adjacent portions of the wedge 3 and the flat surface 4 of the hoop attachment device 2 (see FIG. 1) when the hoop 1 is attached to the elongated body 12 as will be described in greater detail below.

Preferably, four fastener holes 30 are located along the length of the elongated body 12, and pass from the upper surface 14 through to the lower surface 16 of the elongated body 12. The fastener holes 30 are preferably sized to receive fasteners (not shown) which pass through the elongated body 12 and into holes within a hooping device work surface (also not shown) where they are secured. Preferably, the fasteners are either screws which are threaded and secured in place on the elongated body 12 and the hooping device work surface by wing nuts (not shown), or are pins passed through the fastener holes 30 and into matching holes within the hooping device work surface. The number and spacing of the fastener holes 30 depends largely upon the spacing and orientation of holes within the hooping device work surface. As such, the number of fastener holes 30 can be fewer or more as desired, and can be located in different spaced relationships than the particular arrangement shown in the Figures.

Figure 8:
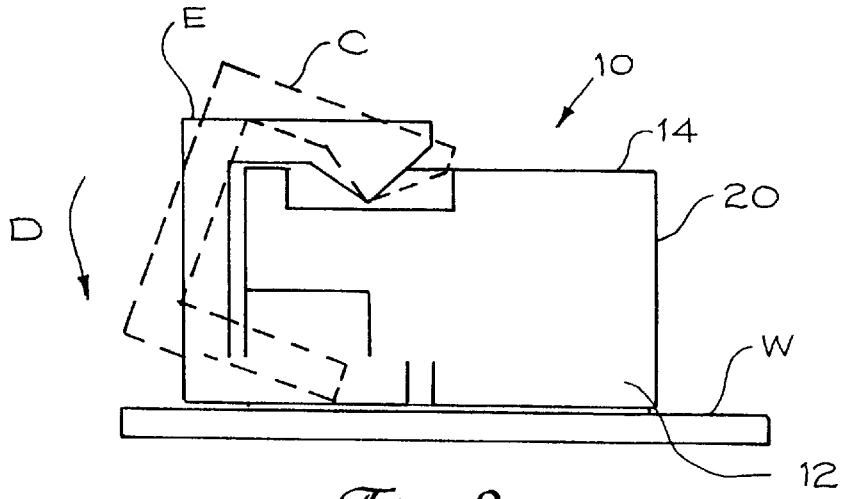
FIG. 8 is the cross-sectional view of the bracket shown in FIG. 7, further showing the bracket's installation and removal upon a hoop.

In use, the elongated body 12 is first preferably attached to a hooping device work surface W by placing the elongated body 12 with its lower surface 16 face down upon the hooping device work surface W, passing fasteners through the fastener holes 30 in the elongated body 12 and through matching holes within the hooping device work surface W, and then tightening the fasteners in place via nuts. Next, the wedge 3 of a hoop's attachment device 2 is placed within the upper groove 22 of the body 12 as shown in the position indicated by letter C in FIG. 8. In this position, the hoop 1 is oriented at an angle to the elongated body 12 as shown in FIG. 8. The hoop 1 is then lowered in the direction indicated by arrow D until it reaches the hoop position indicated by letter E in FIG. 8. To clear the end wall 5 and the adjacent areas of the wedge 3 and the flat surface 4 during the swinging motion, the notch 26 is sized to receive these portions of the hoop attachment device 2. In the position indicated by the letter E in FIG. 8, the elongated body 12 of the hoop 1 is fully installed within the hoop attachment device 2, and the hoop 1 is secured to the hooping device work surface W. Specifically, the wedge 3 holds the hoop 1 against downward movement, the flat surface 4 (which has been swung down below the elongated abutment surface 36 of the elongated body 12) holds the hoop against upward movement, and the lip 32 wedged between the wedge 3 and the back surface 6 of the attachment device 2 holds the hoop 1 against lateral movement. Also, the front surface 18 of the elongated body 12 is preferably pressed up against the side of the hoop 1 when the elongated body 12 is in position E shown in FIG. 8. This abutting relationship between the elongated body 12 and the hoop 1 also prevents lateral movement of the elongated body 12 with respect to the hoop 1. Secured in this manner, the hoop 1 is prevented from shifting or moving with respect to the hooping device work surface W during hooping operations.

In order to release the hoop 1 from the hooping device work surface W, the hoop is lifted from the position indicated by the letter E to the position indicated by the letter D in FIG. 8. This motion permits the wedge 3 and the flat surface 4 of the hoop attachment device 2 to clear the lip 32 and the elongated abutment surface 36, respectively, of the elongated body 12. The hoop 1 can then be removed from the elongated body 12 and the hooping device work surface W. It will be noted that a relatively small swinging motion is necessary to insert and release the elongated body 12 into and out of the attachment device 2 and hoop 1. No shiffing or sliding motion is necessary to engage or disengage the hoop 1, and thus, the object which is hooped need not be shifted or slid on the work surface W.

Figure 7:
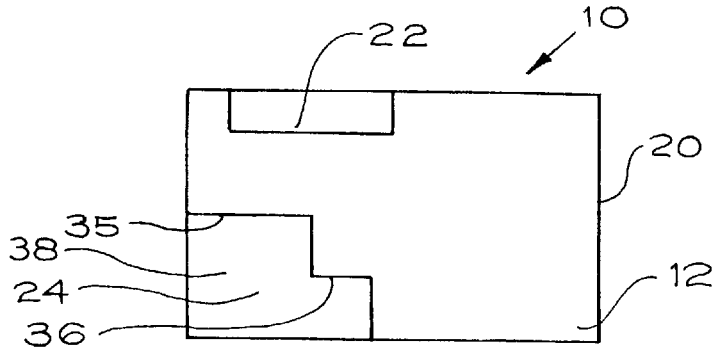
FIG. 7 is a cross-sectional view of the bracket shown in FIGS. 2 and 3, taken along lines 7—7 in FIGS. 2 and 3.

As can best be seen in FIG. 7, the lower recess 24 of the elongated body 12 is preferably stepped to define the elongated abutment surface 36 and the cut-out area 38. The elongated abutment surface 36 is preferably shaped to flatly abut against the flat surface 4 of the attachment device 2 when the attachment device 2 is swung into the attached position (see position E in FIG. 8). The cut-out area 38 is preferably provided in order to allow adequate clearance of the flat surface 4 of the attachment device 2 as it is swung around the underside of the elongated body 12. It will be appreciated by one having ordinary skill in the art that other shapes and sizes of the elongated abutment surface 36 and the cut-out area 38 are possible. For example, the elongated abutment surface 36 can instead be one or more short posts, ribs, ledges, wedges etc. of varying sizes, angles and shapes. In all such cases, an abutment surface is preferably provided against which the flat surface 4 of the attachment device 2 can abut when the hoop 1 is in its attached position on the elongated body 12. Also, in all such cases, adequate clearance is preferably provided to allow the flat surface 4 of the attachment device 2 to rotate around the elongated body 12 and into place abutting the abutment surface(s) 36. Given this adequate clearance, any shape or orientation of the abutment surface(s) 36 is possible as noted above.

It will also be appreciated by one having ordinary skill in the art that the lip 32 and the upper groove 22 of the elongated body can also vary considerably in their respective shapes and sizes. For example, although a lip width sized to match the width between the wedge 3 and the back surface 6 of the attachment device 2 is preferred for a snug fit, other lip widths are possible. The lip 32 can instead take a broken shape or be one or more posts, blocks, or wedges arranged in the general location of the lip 32. In all such cases, the wedge 3 of the attachment device 2 abuts up against part of the elongated body 12 located on the upper surface 14 of elongated body 12. In this regard, an upper groove 22 is not absolutely required, depending upon the particular shape and type of lip 32 employed.

The elongated body 12 can be made from any number of rigid or semi-rigid materials, such as plastic, wood, metal, composites, ceramics, stone, glass, or combinations thereof However, the elongated body 12 is preferably made from a machinable engineered plastic such as Delrin (trademark of DuPont Corporation).

Figure 4:
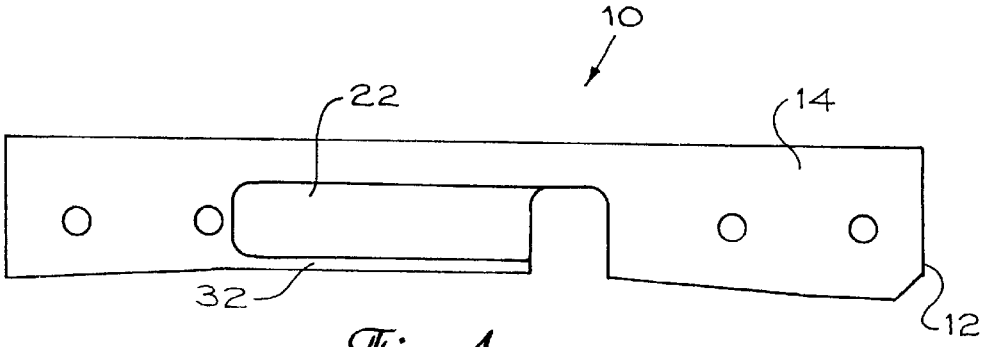
FIG. 4 is a front elevational view of the bracket shown in FIGS. 2 and 3.
Figure 5:
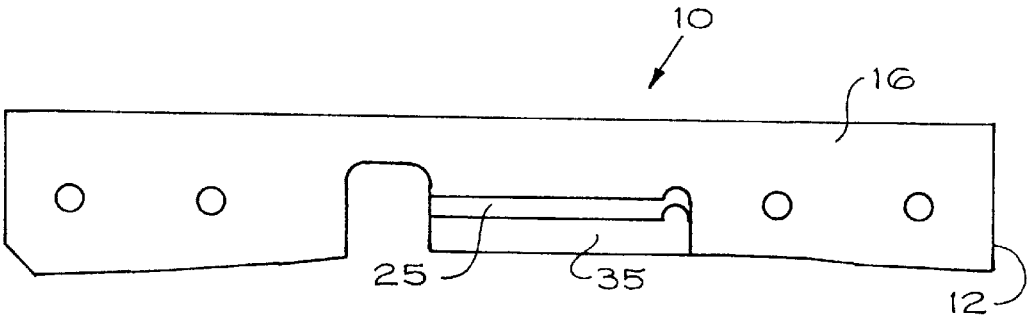
FIG. 5 is a rear elevational view of the bracket shown in FIGS. 2 and 3.
Figure 6:
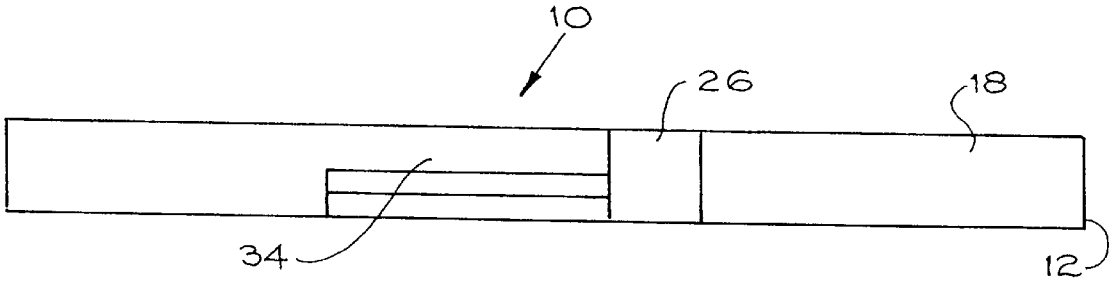
FIG. 6 is a side elevational view of the bracket shown in FIGS. 2 and 3.
Figure 9:
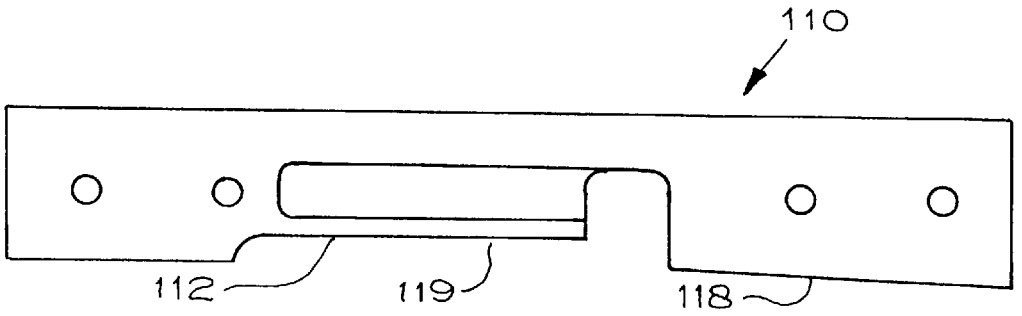
FIG. 9 is front elevational view of a second embodiment of the hoop bracket according to the present invention.

A second preferred embodiment of the present invention is shown in FIG. 9. The embodiment shown in FIG. 9 differs from that shown in FIGS. 1–8 in one primary way: the shape of the front surface 118 of the elongated body 112. As can be seen from comparison of FIGS. 4 and 9, the shape of the front surface 118 is substantially flat (rather than concave as with the front surface 18 of the elongated body 12) with a front recess 119 located in a middle portion of the elongated body 112. The front surface 118 of the elongated body 112 is shaped to match the outer surface of the hoop 1 which is to be attached to the elongated body. When the elongated body 112 is installed within the attachment device 2 of the hoop 1, the outside surfaces of the hoop 1 preferably abut against the front surface 118 of the elongated body 112 for extra stability. As such, the particular elongated body 112 shown in FIG. 9 is intended to be used with hoops having a substantially flat side alongside the attachment device 2 (e.g., for substantially rectangular or square hoops 1). In comparison, the elongated body 12 of the first embodiment shown in FIG. 4 is intended to be used with hoops having a substantially curved side near the attachment device 2 (e.g., for oval or round hoops, or for hoops having bowed sides). It should be noted that other fixtures on the hoops 1 can necessitate the alteration of the outline of the elongated elements 12, 112 shown in the Figures in order to fit the hoops 1 on the elongated elements 12, 112. Also, It will be appreciated by one having ordinary skill in the art that though preferred, abutment of the front surface 18, 118 of the elongated body 12, 112 against the attached hoop 1 is not absolutely necessary to practice the present invention. Such an abutting relationship is desirable, however, because it provides for a more stable connection between the hoop 1 and the elongated body 12, 112.

The embodiments disclosed above and illustrated in the figures are presented by way of example only and are not intended as a limitation upon the concepts and principles of the present invention. For example, although elongated bodies 12, 112 are shown in the Figures, any body shape is possible, including bodies which are not elongated. Such bodies can have the same elements and features described above with reference to the first and second preferred embodiments of the present invention. It will be appreciated by one having ordinary skill in the art that various changes in the elements and their configuration and arrangement are possible without departing from the spirit and scope of the present invention as set forth in the appended claims.

Having thus described the invention, what is claimed is:

1. An apparatus for securing an embroidery hoop, comprising:

a body having a top surface;

a front surface adjoining the top surface;

a lip located on the top surface and running along a length of the top surface near the front surface;

a bottom surface having a recessed section contiguous with the front surface, and a base surface within the recessed section; and an abutment surface within the recessed section of the bottom surface, the abutment surface being raised from the base surface of the recessed section.

2. The apparatus as claimed in claim 1, wherein the lip is defined by a groove formed within the body running along a length of the top surface.

3. The apparatus as claimed in claim 1, wherein the abutment surface is a step raised from the base surface of the recessed section.

4. The apparatus as claimed in claim 3, wherein the abutment surface is substantially parallel to the top surface of the body.

5. The apparatus as claimed in claim 1, wherein at least a portion of the recessed section of the bottom surface is stepped, the abutment surface being a top surface of a step in the stepped portion of the recessed section.

6. The apparatus as claimed in claim 1, wherein the body has at least one fastener aperture formed therethrough and adapted to receive a fastener passing through the top surface and the bottom surface of the body.

7. The apparatus as claimed in claim 1, wherein the front surface is shaped to conform to an outside surface of the embroidery hoop.

8. The apparatus as claimed in claim 7, wherein the front surface is slightly concave.

9. An apparatus for securing an embroidery hoop, comprising a body having a ledge formed thereon, the ledge having an upper surface;

a underside surface located below the upper surface;

an outer edge joining the upper surface and the underside surface;

a base section connecting the ledge to the body;

a lip running on the upper surface along the outer edge;

an abutment surface located on the underside surface between the outer edge and the base section, the abutment surface being raised from the underside surface of the ledge.

10. The apparatus as claimed in claim 9, wherein the body further comprises a bottom surface, the underside surface of the ledge being recessed from the bottom surface to define a recessed section of the body below the ledge.

11. The apparatus as claimed in claim 10, wherein the abutment surface on the underside surface of the ledge is raised above the underside surface of the ledge but is recessed with respect to the bottom surface of the body.

12. The apparatus as claimed in claim 10, wherein the abutment surface is a step connecting the bottom surface of the body and the underside surface of the ledge.

13. The apparatus as claimed in claim 9, wherein the lip is defined by a groove formed within the upper surface of the body along the outer edge of the body.

14. The apparatus as claimed in claim 9, further comprising a notch formed within the body through the ledge, the notch adapted to receive a part of an attachment device of the hoop.

15. The apparatus as claimed in claim 9, wherein the body further comprises an edge on at least one side of the ledge, the edge being shaped to match an exterior shape of the hoop.

16. The apparatus as claimed in claim 15, wherein the edge is concave, and has at least a portion which fits flush against the hoop when installed.

17. A method for releasably connecting an embroidery hoop to a work surface, the embroidery hoop having a wedge and a flat surface in facing relationship with the wedge, the method comprising:

providing a body having an upper surface, a ledge with an outer edge, a lip on the upper surface and running along the outer edge of the ledge, and a recessed surface beneath the ledge;

orienting the hoop at an angle with respect to the upper surface of the body;

inserting the wedge of the hoop over and behind the lip of the body;

lowering the hoop to a secured position alongside the body in which the flat surface of the hoop abuts the recessed surface beneath the ledge.

18. The method as claimed in claim 17, further comprising the steps of:

lifting the hoop to an angled position with respect to the upper surface of the body in which the flat surface of the hoop is disposed from the recessed surface beneath the ledge; and lifting the wedge of the hoop from behind the lip on the body to release the hoop from the body.

19. The method as claimed in claim 17, further comprising the step of fastening the body to the work surface via at least one fastener, the upper surface of the body facing upward when the body is fastened to the work surface.

20. The method as claimed in claim 17, wherein the lip of the body is defined by a groove formed in the body substantially parallel to the outer edge of the ledge.

* * * * *